US006987230B2

(12) United States Patent
Hansen

(10) Patent No.: US 6,987,230 B2
(45) Date of Patent: Jan. 17, 2006

(54) LIMIT SWITCH

(75) Inventor: Robert A. Hansen, Oakdale, MN (US)

(73) Assignee: Dynamic Air Inc., St. Paul, MN (US)

( * ) Notice: Subject to any disclaimer, the term of this patent is extended or adjusted under 35 U.S.C. 154(b) by 190 days.

(21) Appl. No.: 10/657,794

(22) Filed: Sep. 5, 2003

(65) Prior Publication Data

US 2005/0051411 A1 Mar. 10, 2005

(51) Int. Cl.
*H01H 15/14* (2006.01)

(52) U.S. Cl. ..... 200/47; 200/334

(58) Field of Classification Search ..... 200/47, 200/308, 334, 336, 19.03, 19.2, 19.18, 33 B, 200/81 R, 81.9 R
See application file for complete search history.

(56) References Cited

U.S. PATENT DOCUMENTS 3,793,492 A * 2/1974 Duncan et al. ..... 200/47
4,701,582 A * 10/1987 Hayashi et al. ..... 200/61.42
5,552,570 A * 9/1996 Shinohara et al. ..... 200/47
5,865,301 A * 2/1999 Kawabe et al. ..... 200/313
6,518,528 B2 * 2/2003 Nickerson et al. ..... 200/447
6,668,779 B2 * 12/2003 Hendriksma et al. .... 123/90.44

* cited by examiner

*Primary Examiner*—Elvin Enad
*Assistant Examiner*—Lisa Klaus
(74) *Attorney, Agent, or Firm*—Jacobson & Johnson

(57) ABSTRACT

A limit switch having a housing carrying one or more components that are individually field replaceable by an operator so that an operator can make an on-the-go field repair any faulty component in the limit switch. The field replaceable components can be frictionally or mechanically secured by a finger operable latch or the like so that an operator can remove and quickly replace a faulty component while the limit switch is connected a pneumatic conveying system or the like.

29 Claims, 3 Drawing Sheets

LIMIT SWITCH

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

FIELD OF THE INVENTION

This invention relates to a limit switch and, more particularly, to a field serviceable limit switch that can provide an operator with information on the condition of a component or system such as on a pneumatic conveying system.

BACKGROUND OF THE INVENTION

The concept of limit switches for indication of the status of a component is generally known in the art. In general, indicators with electrical switches and cam members are packaged as a unit. When the limit switch malfunctions in the field one has to replace the entire limit switch. As the replacement can be time consuming as well as costly it is desirable to eliminate the system down time as well as the cost to replace an entire limit switch.

The present invention provides a field serviceable limit switch that includes a status indicator that visually alerts an observer to the condition of a particular component or components of a system such as a valve or the like in a pneumatic conveying system. The limit switch can also be used to control various other components in the pneumatic system as well as to indicate the presence of a faulty or dangerous condition in a system such as in a pneumatic conveying system.

Typically, the field serviceable limit switch can include such items as field replaceable electrical switches, field replaceable terminal blocks, field replaceable cams and field replaceable cam holders, field replaceable transducers, field replaceable indicators and a field replaceable transparent housing. By field replaceable part it is meant that an individual part can be quickly replaced by an operator in the field with few or no hand tools and without the need to replace the entire limit switch.

SUMMARY OF THE INVENTION

Briefly, the present invention comprises a limit switch having a housing carrying one or more components that are individually field replaceable by an operator so that an operator can make an on-the-go field repair any faulty component in the limit switch. The field replaceable components can be frictionally or mechanically secured by a finger operable latch or the like so that an operator can remove and quickly replace a faulty component while the limit switch is connected a pneumatic conveying system or the like.

DESCRIPTION OF THE PREFERRED EMBODIMENT

Figure 1:
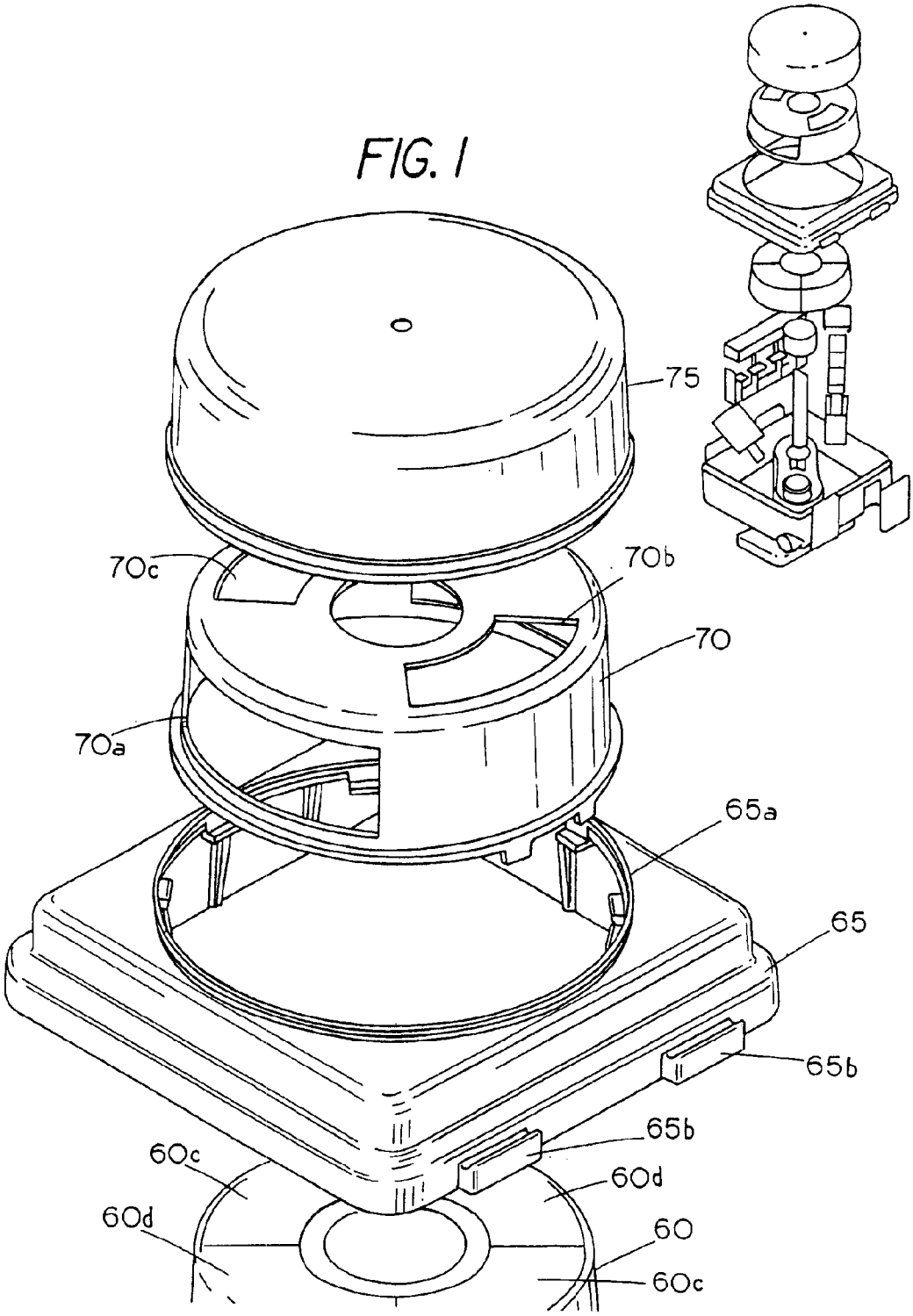
FIG. 1A is an exploded view of the alerter
FIG. 1B is an exploded view of the limit switch
Figure 1B:
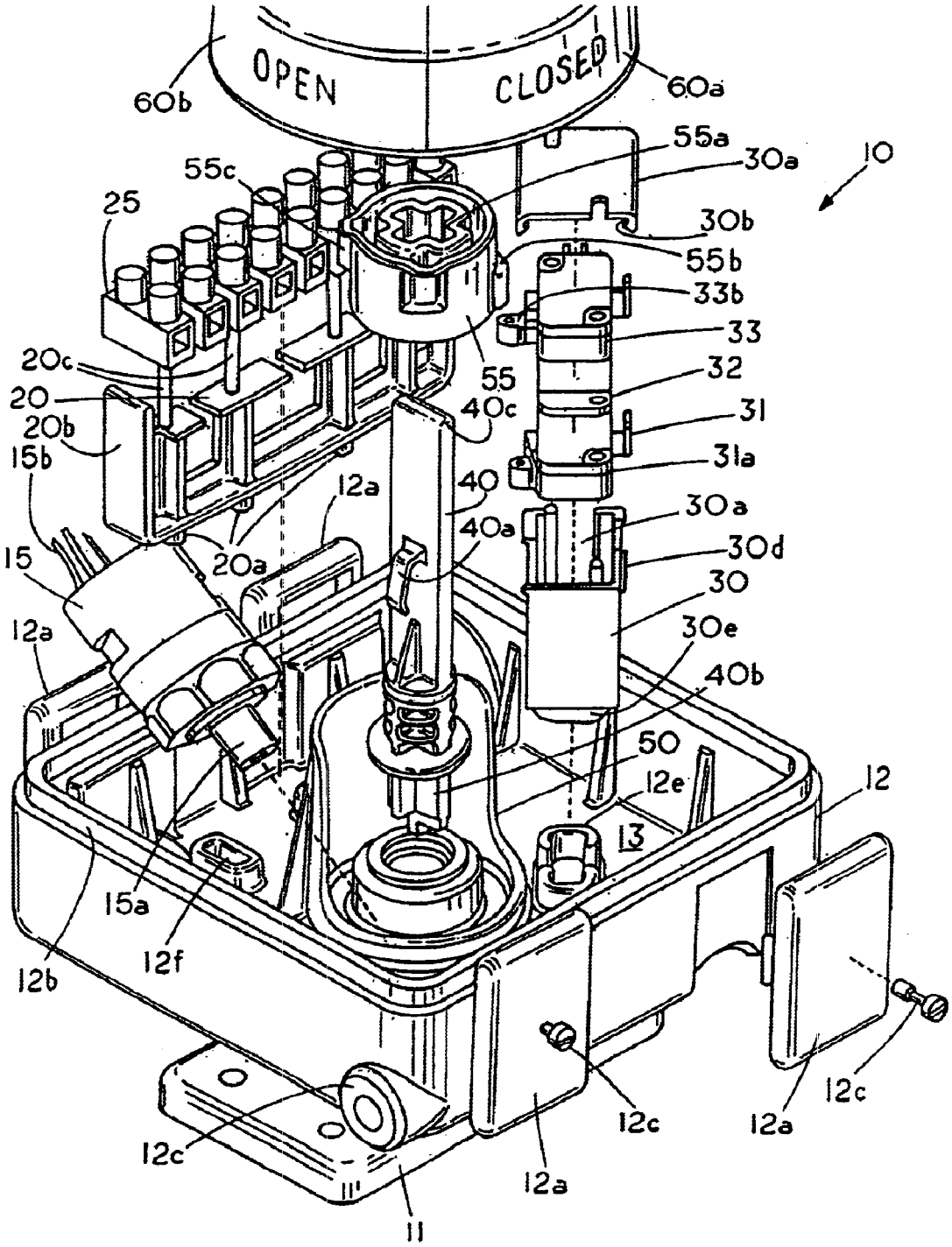

FIG. 1B shows an exploded view of a limit switch 10. Limit switch 10 includes a base 11 for securing to a mount or the like. Base 11 carries a square shaped housing 12 having a chamber 13 therein. Housing 12 contains a set of snap latches 12*a* located on opposite sides for releasable securing a cover 65 thereto. Each of snap latches 12*a* include a fastener 12*c* for securing the snap latch 12*a* to the housing 12. Located around the top peripheral region of housing 12 is a lip 12*b* that forms a shoulder for supporting cover 65 thereon. Base 11, housing 12 and cover 65 are preferable made from a polymer plastic or the like.

Located within the housing 12 are a number of replaceable components that are releasably secured to permit field replacement of the limit switch components thus avoiding the need to replace an entire limit switch if one component fails.

Limit switch 10 includes an alerter or visual indicator 60 to provide an observer a status indication of the equipment being monitored. For example, the limit switch might be used to indicate whether a valve is in an open or closed condition as well as to control other components in a system such as a pneumatic conveying system.

FIG. 1B shows a centrally positioned cam shaft 40 rotationally supported in housing 12. Located on cam shaft 40 is a cam shaft 40*a* for removably securing a cam 55 thereon. Cam 55 includes a cross shaped slot 55*a* for mechanical engagement with cam shaft 40 to permit the cam shaft 55 to rotate the cam 55. Located on one side of cam 55 is a cam lobe 55*b* and on the other side is a cam lobe 55*c*. In assembly of cam shaft 40 and cam 55 the cam 55 is slid longitudinally downward along shaft 40, which forces the cantilevered resilient latch to cantilever inward and allow cam 55 to slide therepast. Once the cam 55 is past the cam latch 40*a* the resilient cam latch 40*a* snaps outward to prevent withdrawal of the cam 55 from the cam shaft 40*a*. To remove and replace cam 55 one can squeeze cam latch 40*a* toward cam 40 thus allowing cam 55 to be slide upward and off the cam shaft 40.

The lower end of cam shaft 40 includes an end 40*b* for engaging with a device that connects to the system being monitored. For example, cam shaft 40*b* can be connected to the pivot member on a butterfly type valve in a pneumatic conveying system to cause the cam shaft 40 to rotate as the butterfly valve is opened or closed. The top end 40*c* of cam shaft 40 engages a dome shaped visual indicator 60 as shown in FIG. 1A. Dome shape indicator 60 includes a female receptacle (not shown) that mechanically connects to cam shaft 40 to cause the indicator 60 to rotate as the cam shaft 40 rotates. The dome shaped indicator 60 includes a first peripheral region 60*a* with a first readable visual message such as "CLOSED" and a second peripheral region 60*b* with a second readable visual message such as "OPEN".

In order for a person to obtain the information on the system or component status a masking cover 70 is provided that includes a first peripheral opening 70*a* that permits viewing the readable message on one or the other of the peripheral regions 60*a* and 60*b* therethrough. That is, on one condition the "OPEN" message can be visible through peripheral region 70*a* to let the operator no that the component being monitored is in an open condition. Similarly, in another condition the "CLOSED" message can be visible through opening 70*a* to let the observer know the component is in a closed condition.

Indicator 60 provides dual signals or dual visual indicators, one that is visible in a lateral direction from the limit switch and one that is visible from above the limit switch. The second visual indicator comprises a color coded regions 60*c* which comprises truncated pie shaped segments on the top surface of indicator 60. For example, regions 60*c* can be colored red so as to indicate that a component being monitored is in a closed condition. Spaced adjacent to color coded peripheral region 60*c* are two additional truncated pie shaped colored regions 60*d*. Regions 60*d* can be color coded green to indicate the monitored component is in the open condition.

Located on top of indicator drum 60 is masking cover 70 that includes a first truncated pie shaped opening 70*c* and a second diagonally positioned truncated pie shaped opening 70*b*. In operation of the limit switch 10 the color coded regions 60*c* or 60*d* are visible through the truncated pie shape openings 70*b* and 70*c*. For example, in one condition color coded regions 60*c*, which may be red to indicate a closed condition, are visible through; the openings 70*b* and 70*c* to indicate the component is in a closed condition. In another condition the color coded regions 60*d*, which can be green to indicate an open condition, are visible through the openings 70*c* and 70*b* to indicate the component is in an open condition.

The use of a solid color coded region also provides a proportional signal. That is, if a portion of the red coded region 60*c* and a portion of the green coded region 60*d* are visible in the opening 70*c* and 70*b* one can determine the condition of the component. For example, one could determine that the component being monitored, such as a butterfly valve, is in a 50% open condition by observing that half of the green colored region 60*d* is visible and half of the red colored region 60*c* is visible through the openings 70*b* and 70*c*.

In order to protect the indicator 60 from the environmental conditions there is provided a cup shaped transparent member 75 that fits over the masking cover 70 and the visible indicator 60 to permit an observer to observe the visual signals from the indicator 60 from either a lateral position with respect to the limit switch 10 or a position above the limit switch 10.

Figure 2:
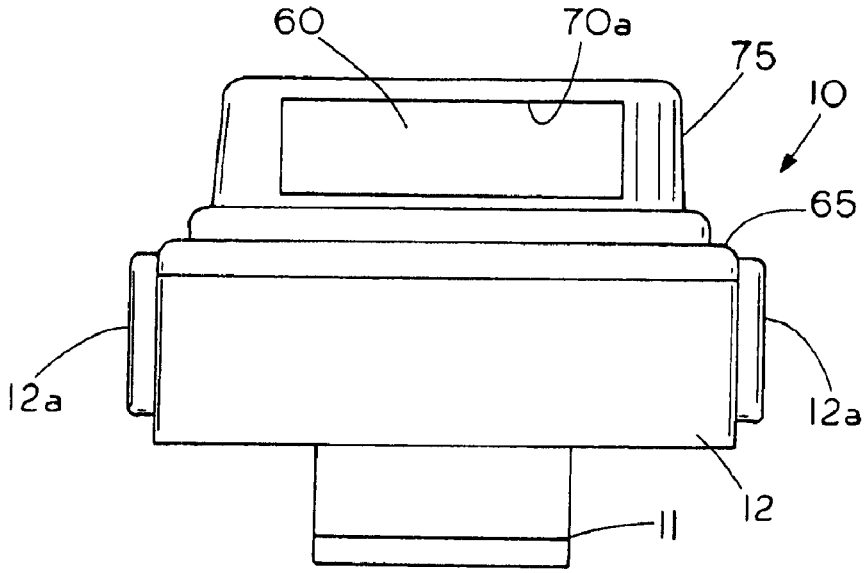
FIG. 2 is a side view of the limit switch in assembled condition.

FIG. 2 shows the transparent member 75 and masking cover 70 can be secured directly to the top of cover 65 along the circumferential edge 65*a* on cover 65. This allows one to assemble the cover 65 and transparent member 75 as a unit to the housing 12. A set of four identical tabs 65*b* located on opposite sides (only two are shown) allow one to use snap latches 12*a* to secure the cover 65 to the unit to form a closed and protected limit switch with alerter (see FIGS. 1A and 1B). Thus a person positioned laterally of limit switch 10 can view the indicator 60 through the peripheral opening 70*a* in masking cover 70.

The cam shaft 40*a* and indicator 60 in cooperation with cover 65, housing 12 and transparent cover 75 can provide a visual indication of the status of a component through the rotational displacement of the cam shaft 40. A further feature of the invention is that the cam shaft 40 can be used to control an electrical circuit. In order to appreciate the control of an electrical circuit reference should be made to FIG. 1, which shows a switch holder 30 comprising a box like member extending upwardly in the housing 12. Switch holder 30 contains a chamber 30*f* for receiving a first electrical switch 31 having a cantilevered roller arm 31*a* and second electrical switch having a cantilevered rolling arm 33*b*. Such switches are well known in the art and are readily available as off-the-shelf items. The switches have two conditions, an off condition and an on condition. In one type of switch the off condition occurs when the roller arm is depressed and in another type of switch the on condition occurs when the roller arm is depressed. Each of the switches 31 and 32 are peripherally held in position by the sidewalls of the box like switch holder 30 so that no screws or the like are required to secure the switches in an operating condition proximate cam 55.

Figure 3:
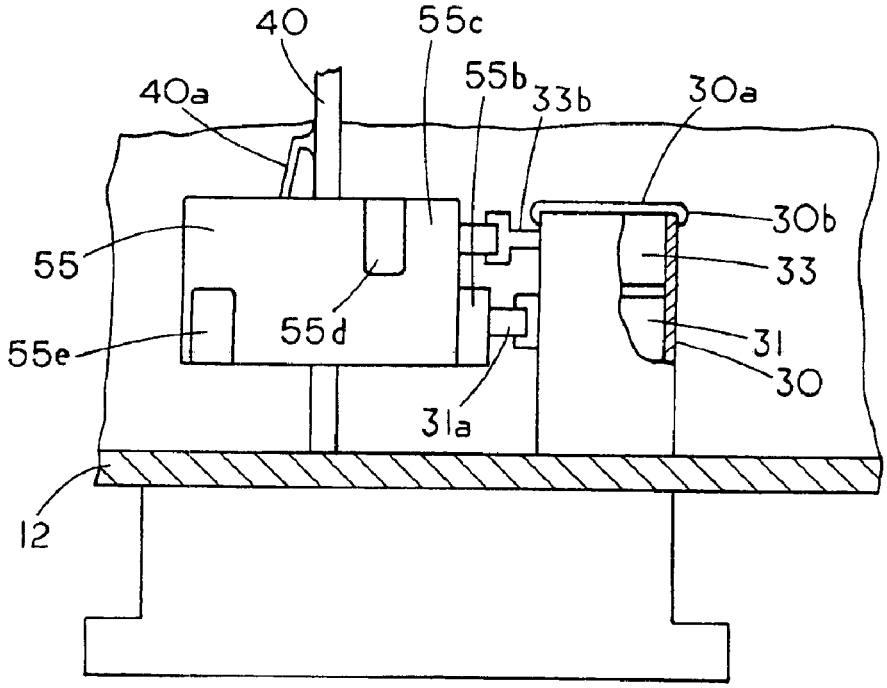
FIG. 3 is a partial side view of the of the cam with the cam rollers on electrical switches carried in the housing of the limit switch.

FIG. 3 shows an isolated view of the switch holder 30 and the cam 55 in engagement with each other. In this embodiment two switches 31 and 33 are removably secured in switch holder 30 by a cover 30*a* having a lip or latch 30*b* that engages switch holder 30 to secure the switches 31 and 33 in a fixed condition in switch holder 30. In this condition the cantilevered resiliently mounted roller arms 31*a* and 33*b* protrude outward from switch holder 30 and are in an operable position to engage the cam 55. In the position shown a cylindrically cam surface 55*c* is in contact engagement with roller arm 33*b* and the cam lobe 55*b* is in contact engagement with roller arm 31*a*. Additional cam lobes 55*d* and 55*e* provide for additional contact with the roller arms. As cam shaft 40 rotates the different cam lobes 55*d* and 55*e* are brought into contact with the roller arms on the switches 31 and 33 to bring the switches 31 and 33 to proper on or off condition. Thus, a feature of the invention is that a conventional electrical switch can be quickly inserted or removed from switch holder 30 by merely engaging or disengaging snap latch cover 30*a* which includes ears for engaging the peripheral lip extensions 30*d* on switch holder 30. In the embodiment shown switch holder 30 includes a base 30*e* that can be secured to extension 12*e* in housing 12 to allow for removal and replacement with few or no hand tools. (See FIG. 1B)

A further feature of the invention is the inclusion of an electrical terminal block holder 20 which is shown in FIG. 1B. Terminal block holder 30 comprises a frame like member having a set of cylindrical pegs 20*c* that extend upward. The lower portion of block holder 20 includes an extension 20*a* for frictionally engaging extension 12*f* in housing 12 to hold electrical terminal block holder 20 thereon. Once the terminal block holder 20 is secured to housing 12 the terminal block 25 is positioned on the cylindrical pegs 20*c* to prevent lateral movement thereon. The side member 20*b* of block holder 20 comprises a resilient member having a lip (not shown) that latchingly engages one end of the terminal block 25 to hold one end of the terminal block in position in housing 12. An identical side member (not shown) is located on the opposite end of block holder 20 to hold the opposite end of the terminal block 25 in position.

An interface device 15, which can be a transducer or the like that relates a pneumatic condition to an electrical condition, can be secured to housing 12 through an extension 15*a* to enable a pressure signal to be transferred through fastener 12*c* to interface device 15 though the sidewall of housing 12. The interface device 15 includes a set of electrical leads 15*b* for connection to the electrical terminal block 25. The electrical leads are omitted for purposes of clarity, but in operation the electrical leads 15*b* can extend from the interface device 15 to the terminal block 25 and from the terminal block 25 to the connector lugs (not shown) on the electrical switches 31 and 33. Thus a further feature of the invention is that the terminal block is removably mounted in housing 12 and can be replaced as well as the terminal holder 20. In addition, the chamber 13 in housing 12 can carry both electrical components as well as mechanical components with either or both of the electrical and mechanical components field replaceable.

A further feature of the invention is that extending partially around cam shaft 40 and extending vertically upward is a wire guard 50 that is fixedly supported in housing 12. Wire guard 50 extends upward and circumferentially to prevents wires in housing 12 from being accidentally caught by the rotating cam shaft 40*b*.

In operation of the limit switch an operator can quickly open the limit switch by releasing the latch 12*a* to allow removable of the cover 65. Once the cover 65 is removed the operator can obtain access to the components that are held in the housing 12. An operator can then quickly replace the faulty component and replace the cover thus allowing the system to be up and running with a minimum of delay.

I claim:

1. A field serviceable limit switch with an alerter:

a base;

a housing supported on said base, said housing having a chamber therein;

a cam shaft, said cam shaft rotationally supported by said housing, said cam shaft having a cam latch thereon;

a cam, said cam removable secured to said cam shaft by said cam latch;

an indicator, said indicator connected to said cam shaft for providing alert information;

an interface device, said interface device removably supported by said housing;

an electrical terminal holder secured in said housing;

an electrical terminal block, a terminal holder latch releasably securing said electrical terminal block to said terminal holder;

a switch;

a switch holder, said switch holder secured in said housing, said switch holder having a switch holder latch thereon, said switch holder latch releasably securing said switch in said switch holder to facilitate replacement thereof; and a wire guard, said wire guard shielding said cam shaft from rotational interference.

2. The field service limit switch of claim 1 including a cover for securing to said housing.

3. The field serviceable limit switch of claim 2 including a set of latches on said housing for securing the cover to said housing.

4. The field serviceable limit switch of claim 1 wherein the switch holder is frictionally secured in said housing.

5. The field serviceable limit switch of claim 1 wherein the terminal block holder is frictionally secured in said housing.

6. The field serviceable limit switch of claim 1 wherein the indicator includes a region with a first marking and an adjacent region with a second marking with said second marking different from said first marking.

7. The field serviceable limit switch of claim 1 wherein the wire guard extends partially around said cam shaft.

8. The field serviceable limit switch of claim 1 wherein said cam includes a plurality of lobes for actuating the switch.

9. The field serviceable limit switch of claim 1 including a transparent dome for viewing the indicator therethrough.

10. A field serviceable limit switch comprising:

a housing;

an electrical switch removably mounted in said housing;

a cam shaft removably and rotationally mounted in said housing, said cam shaft carrying a cam for activation of the electrical switch; and an indicator, said indicator connected to said cam shaft to provide a status indication in response to a rotation of said cam shaft.

11. The field service limit switch of claim 10 including a removable terminal block holder located in a chamber in said housing.

12. The field service limit switch of claim 11 including a removable terminal block mounted on said terminal block holder.

13. The field service limit switch of claim 12 including a wire guard extending at least partially around said cam shaft.

14. The field service limit switch of claim 10 wherein the cam is removable mounted on said cam shaft.

15. The field service limit switch of claim 10 including a transducer removably mounted in said housing for interfacing signals between a pneumatic device and an electrical device.

16. The field service limit switch of claim 10 including a set of latches secured to said housing for securing a cover to said housing.

17. The field service limit switch of claim 10 wherein the indicator comprises a rotatable disk like member.

18. The field service limit switch of claim 17 wherein a transparent shield cover the indicator to allow the indicator to be viewed from two mutually perpendicular directions.

19. The field service limit switch of claim 10 wherein the housing is plastic.

20. A field serviceable limit switch comprising:

a housing;

a cover for said housing;

a cam shaft, said cam shaft rotationally mounted in said housing, said cam shaft carrying a cam; and an indicator, said indicator connected to said cam shaft to provide a status indication in response to a rotation of said cam shaft with at least one of said cam shaft or said indicator field replaceable.

21. The field serviceable limit switch of claim 20 wherein the cam is latchable to said cam shaft.

22. The field serviceable limit switch of claim 20 wherein the indicator is supported in a transparent indicator cover.

23. The field serviceable limit switch of claim 20 wherein the limit switch includes at least four different replaceable components.

24. The field serviceable limit switch of claim 20 including an electrical terminal block latchable to a terminal block holder.

25. The field serviceable limit switch of claim 24 wherein the terminal block holder is frictionally secured to said housing.

26. The field service limit switch of claim 20 wherein an electrical switch is confined in a switch holder.

27. A field service limit switch comprising:

a housing, said housing having a first extension for frictionally engaging a switch holder and a second extension for frictionally engaging a terminal block holder with said switch holder carrying replaceable electrical switches and said terminal block holder carrying a replaceable terminal block.

28. The field service limit switch of claim 27 wherein the housing includes a set of snap latches for securing a cover to said housing.

29. The field serviceable limit switch of claim 28 wherein a finger removable terminal block, a finger removable cam and a finger removable electrical switch are located in a chamber in said housing.

* * * * *